United States Patent [19]

Noé

[11] 4,078,739

[45] Mar. 14, 1978

[54] STRIP COILER

[75] Inventor: Oskar Noé, Mulheim (Ruhr), Germany

[73] Assignee: BWG Bergwerk- und Walzwerk-Maschinenbau Gesellschaft mit beschrankter haftung, Duisburg, Germany

[21] Appl. No.: 759,369

[22] Filed: Jan. 14, 1977

[30] Foreign Application Priority Data

Jan. 17, 1976 Germany ..... 2601589

[51] Int. Cl.[2] ..... B65H 75/18; B21C 17/10

[52] U.S. Cl. ..... 242/72.1; 242/78.3; 242/74.1

[58] Field of Search ..... 242/72.1, 72, 74, 74.1, 242/74.2, 78.3

[56] References Cited

U.S. PATENT DOCUMENTS

| | | | |
|---|---|---|---|
| 2,723,086 | 11/1955 | Russell | 242/72 |
| 3,840,197 | 10/1974 | Rodach | 242/78.3 |

FOREIGN PATENT DOCUMENTS

| | | | |
|---|---|---|---|
| 663,947 | 5/1963 | Canada | 242/74.1 |

*Primary Examiner*—Edward J. McCarthy
*Attorney, Agent, or Firm*—Karl F. Ross

[57] ABSTRACT

A strip coiler for the winding of coils from rolled metal strip, especially slit or split strip, comprises a coiling drum provided with a longitudinal surface against which a movable jaw can clamp an end of the strip. The surface or the jaw is formed with an elastic clamping material or an elastic clamping jaw, preferably of rubber, and such material is preferably provided on both the surface and the jaw.

20 Claims, 9 Drawing Figures

STRIP COILER

FIELD OF THE INVENTION

The present invention relates to a strip coiler, i.e., to a coiling drum adapted to form coils of strip metal. More particularly, the invention relates to a coiler for the winding of rolled metal strips into coils, especially for so-called split or slit strips, i.e., rolled strip metal which is longitudinally split or subdivided into a plurality of bands each of which is to be wound into a respective coil on the coiling drum.

BACKGROUND OF THE INVENTION

A coiling drum for the above-described purpose generally comprises a longitudinal slot in which an end of the strip to be coiled is inserted, and means for clamping this end of the strip in place.

Collapsible drum members of this type, i.e., clamping elements which are adapted to recede from the surface of the drum, can be provided as movable drum segments which can be displaced, usually radially, with respect to so-called "fixed drum segments" which, while forming part of the drum and rotating therewith remain radially positioned while the movable segments are displaced to clamp the end of the strip against the fixed segment.

Various structures of this type have been proposed and different mechanisms have been used to actuate the movable segment or clamping member of the drum. These mechanisms can include fluid-operated cylinders, camming or wedge surface and lever arrangements.

One problem which has confronted substantially all of the prior-art coiling drums and, more generally, strip coilers, is the inability to effectively clamp the end of the strip in place under certain conditions and without various drawbacks. For example, when the strip is one band of a plurality of bands longitudinally separated from one another by slitting or splitting following the rolling of the strip, the bands may be of different thicknesses and the firm engagement of one strip may prevent effective engagement of thinner strips. The same defect applies when the strips arrive, not from a shear or slitting arrangement, but from different rolling units to a common coiler.

Another drawback is that an adequate seizure of an end of the strip could not be obtained unless this end were sharply bent upon insertion of the strip into the slot, this creasing operation resulting in a flaw in the strip material and, in many cases, causing kinking or like angular deformities. These flaws "print-through" to the subsequently applied turns of the strip. Yet another drawback has been the tendency of the smooth-surfaced strip to slide out of contact with the fixed clamping surface and the movable clamping surface, the former being provided in or on the fixed member while the latter is provided on the movable clamping member.

Admittedly, attempts have been made to eliminate the second problem by a rounding of the surface at which the slot in the drum merges on to the surface thereof, but this has not been found to be adequate in most instances and does not suffice to prevent defects from arising in the subsequently applied turns unless the strip is drawn with considerable tractive force to hug the rounded surface. This of course creates problems with respect to the force with which the strip must be retained by the clamping device.

Finally, it should be noted that firm gripping of the end of the strip is required to counteract the high tractive forces developing during tight cooling of the strip and this has only been possible with conventional or known band coilers when an angular bend has been formed in the clamped end of the strip. This of course gave rise to the disadvantages enumerated above. It thus has been a matter of considerable investigation to establish a technique for seizing the end of a metal strip in a band coiler without the defects mentioned.

OBJECTS OF THE INVENTION

It is the object of the invention to provide an improved strip coiler which is particularly effective for the simultaneous coiling of a number of strips or bands, e.g., so-called split or slit strip which may be a different strip thickness, which can develop a significant seizure force or grip enabling high coiling tensions to be applied and which permits a smooth transition of the strip from the clamped portion to that portion resting around the circumference of the drum to minimize distortion of subsequent turns.

In addition, it is an object of the invention to provide a simple, reliable and secure gripping system for strip coilers of the type described.

SUMMARY OF THE INVENTION

The foregoing objects are attained, in accordance with the present invention, in a coiling drum, especially for the coiling of strip metal and particularly longitudinally split steel or other metallic strip, which comprises a first and a second drum segment disposed on the coiling drum, one of the segments being provided with means enabling it to be shifted radially relative to the other, the segments having confronting surfaces adapted to clamp an end of the strip between them. According to the invention, at least one of these surfaces is formed with an elastic member adapted to bear with compression against the end of the strip which is clamped between these surfaces.

The surface carrying the elastic member can be the clamping bar or element or the relatively fixed clamping segment. The advantage of this arrangement is that the clamping surfaces can be self-accommodating to the different thicknesses of the strip to be received therebetween so that the strip is clamped uniformly over its entire width and can be engaged with a predetermined clamping force. In the clamping gap, i.e., the slot of the drum into which the end of the strip is inserted, the surface of the strip is not marred by the clamping action because of the presence of the elastic member. Of course, both of the juxtaposed clamping surfaces may be provided with the elastomeric members according to the invention.

Thus the present invention provides a coiling spool or drum which comprises a central core member drum shaft and a number of segment members disposed on the core member so as to be outwardly movable relative thereto, at least one of these segment members defining with a fixed segment on the core or a bar thereon a clamping opening or slot which receives the end of the strip to be engaged. The movable segment member forms one clamping surface and the fixed segment member another clamping surface juxtaposed with the first clamping surface. One of these surfaces is provided with at least one elastomeric or, more generally, a resiliently compressible contact or pressure member adapted to accommodate itself to variations in the thickness of the material to be coiled.

Thus, according to the present invention, the clamped edges of the material to be coiled are not permanently deformed while the coiling operation is undertaken or by the clamping action despite application of relatively high coiling forces. The elastomeric pressure members in the movable or fixed segments permit the use of greater coiling and tension forces while maintaining a uniform clamping force on the leading edge or edges of the material to be coiled.

According to a feature of the invention, the elastically yieldable (generally elastomeric) member is provided with a space, e.g., a hollow or transverse passage formed in this member, into which the material of the member can be compressed. This space, hereinafter termed a compression space, prevents extrusion of the elastic material along the surface of the strip which is clamped and hence prevents permanent deformation of the elastomeric member. Of course, if a hollow or like compression space is not provided in the member itself, one of the segment surfaces in which the member is disposed can be formed, adjacent the member, with a recess or the like into which the elastomeric material can be compressed during engagement with the strip for a similar purpose.

It has been found to be especially advantageous to form the elastomeric clamping members with ball-like or rounded clamping surfaces. To increase the clamping effect, the invention provides further that the clamping bodies are composed of rubber or elastomeric synthetic resins which have a higher coefficient of sliding friction than the usual materials of the clamping bar and drum segments in which these members are accommodated.

Because of the high friction effect thus generated, the danger that the strip will slip out of engagement is reduced, even when split or longitudinally split strip material is to be coiled.

The clamping bodies can be formed as individual members in spaced-apart relationship and in one or more rows, thereby permitting comb-like engagement of the single strip or the individual strip members of a split strip.

Especially effective results are obtained when the elastomeric clamping bodies extend substantially over the full width of the strip to be engaged thereby and when the clamping members form, under compression, continuations of the metal clamping surfaces of the drum segment and the clamping bar. In the latter case it has been found to be advantageous to shape these clamping surfaces as spirals or involutes which merge with the periphery of the drum.

The elastomeric clamping members, can, moreover, be attached to the drum segment and the clamping bar by adhesives, by screw or bolt members or, in a preferred mode of connection, by inserting feet of the clamping members in undercut openings provided in recesses of the surfaces of the drum segment or clamping bar. Such anchoring feet can be of dovetail, T-section or like configuration.

When a spiral configuration of the clamping surface is used, it has been found that this spiral should preferably extend counter to the direction of rotation of the coiling drum and merge uniformly and continuously with the cylindrical drum surface. The spiral transition of the clamping surface to the cylindrical surface of the coiling drum ensures an engagement of the strip which is free from angular bends so that buckling of the ends of the strip does not occur and cannot be transferred to further turns of the coil.

The advantages of the system of the present invention are numerous. Firstly, it permits the coiling of metal strip and especially split strip in a uniform manner without permanent deformation of the end of the strip which is engaged by the coiling drum and, particularly, allows the generation of high coiling forces or application of high tractive forces to the strip.

Since the surfaces which actually apply pressure to the strip are elastically yieldable, damage to the surface of the strip does not occur and, furthermore, since kinking or angular bending of the end of the strip is eliminated, the transfer of angular bending deformations to subsequent turns is completely prevented. Finally, the system permits a reliable clamping of the bands, even when strips of different thicknesses must be engaged by the clamping bar and fixed segment of a clamping drum.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
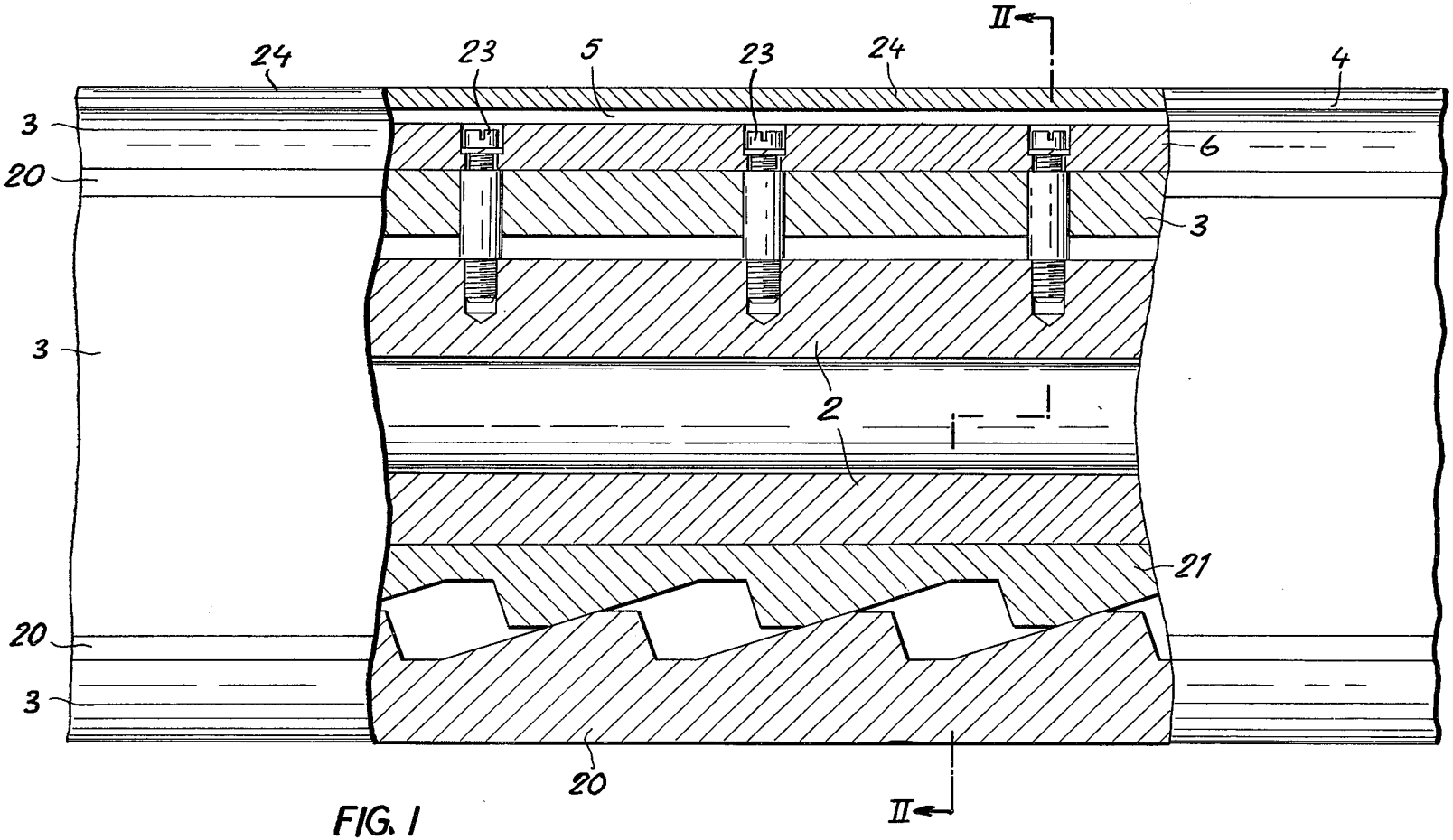
FIG. 1 is a longitudinal side view, partially in cross section along the line I—I of FIG. 2, of a coiling drum or spool mandrel according to the present invention.
Figure 2:
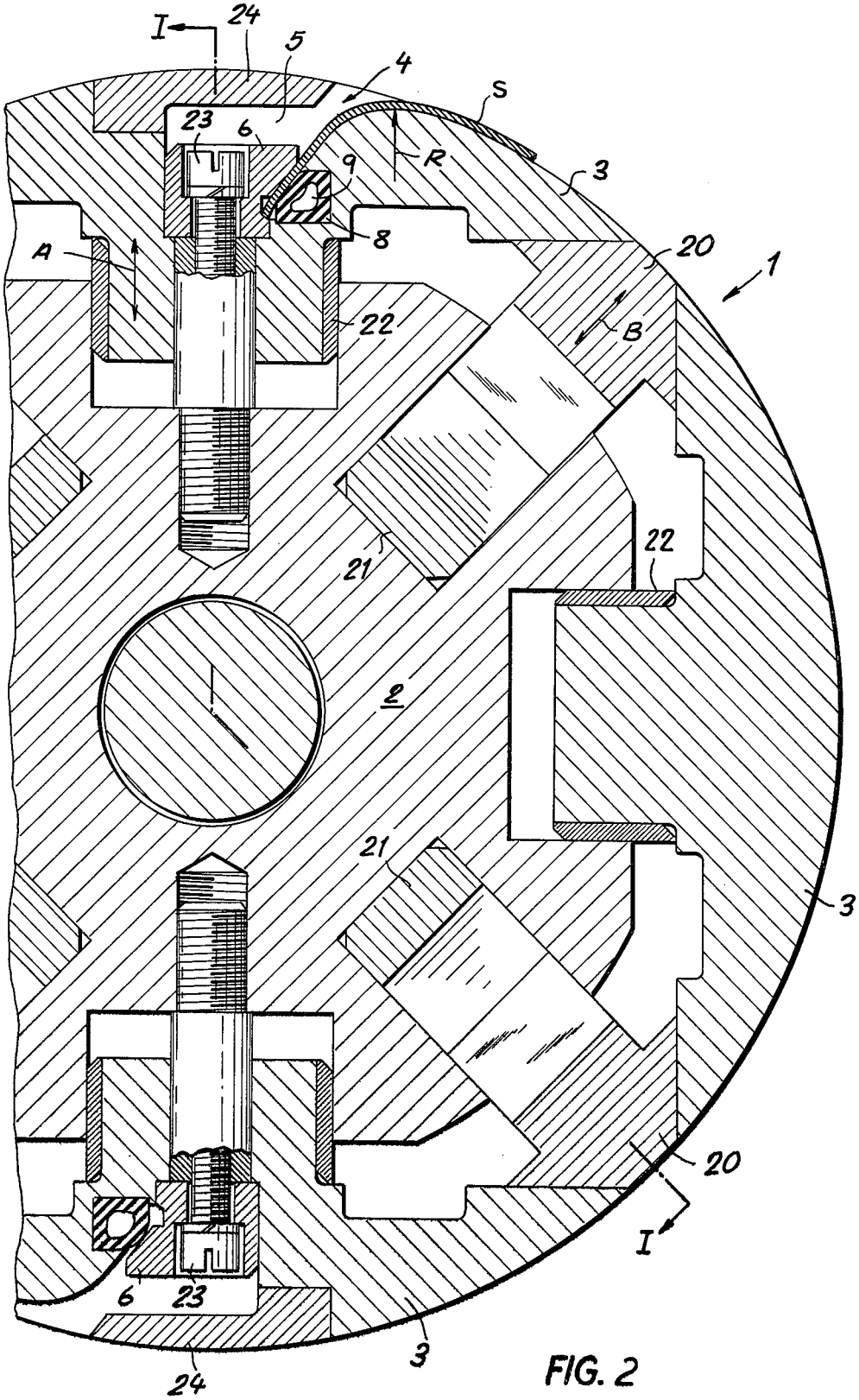
FIG. 2 is a section taken along the line II—II of FIG. 1 showing the spool or coiling mandrel in its clamping position.

As can be seen from FIGS. 1 and 2, the coiling drum or spool mandrel 1 comprises a core 2 and segments 3 which are spaced around the core and are provided so as to be radially shiftable in the direction of arrow A relative thereto by hydraulic means of conventional design, the slide bushings 22 forming pistons in cylinder bores of the core 2 performing this function. Spacers 20 serve to complete the generally cylindrical cross section of the drum 1 and also can be radially movable by hydraulic means or by bearing elements such as are represented at 21 in FIGS. 1 and 2. Bolts 23 anchor clamping bars 6 to the core piece 2, the clamping bar 6 serving as a fixed member against which the movable segment 3 is shiftable to engage an end of a sheet metal strip in the drum.

At least one of the segments 3 is provided with such retention means for the clamping of the leading edge or edges of the strip material to be coiled.

To this end a gap, opening or slot, generally designated by the numeral 4, is provided in the upper rounded surface of segment 3 as can be best seen in FIGS. 2 through 5.

Opening 4 extends normally over the entire length of the drum 1 and communicates with a further recess or groove 5 which likewise extends generally over the entire length of spool 1 and which is arranged in the upper rounded surface of the segment 3. A cover plate 24, outwardly rounded to correspond to the cylindrical configuration of the drum 1, can be attached by bolts or other fastening means to the segments 3.

Cover plate 24, together with the engagement surface 7 for the strip material S, serve to define the gap 4 referred to above.

As can best be seen in FIGS. 1 and 2, the clamping bar 6 is juxtaposed with the clamping surface 7 of the segment 3 and lies directly opposite a pressure member, bar or rod 8 inserted in a recess or groove in contact surface 7 and which is elastically yieldable to directly engage the strip S. Thus when the material S is inserted through gap 4 and between the clamping bar 6 and the pressure member 8 in contact surface 7, it will be clamped between the bar 6 and the pressure member 8. The clamping force can be controlled by the degree to which segment 3 is moved in the direction of arrow A, this movement being controlled, in turn, by the degree to which the spacers 20 are shifted radially outwardly (arrow B) by the camming beams 20, 21. The means for displacing the segment 3 and the spacers 20 are, of course, well known in this art and need not be described in greater detail herein. As can be seen in the various figures of the drawing, the pressure member 8 can be hollow, i.e., provided with a compression cavity 9, can be continuous (i.e., can extend over the full length of the drum) or can be made in sections and disposed in spaced-apart relationship.

The pressure member 8 is preferably composed of rubber or synthetic-resin of elastomeric properties and has a coefficient of sliding friction which is greater than that of the steel of segment 3 or bar 6.

Figure 3:
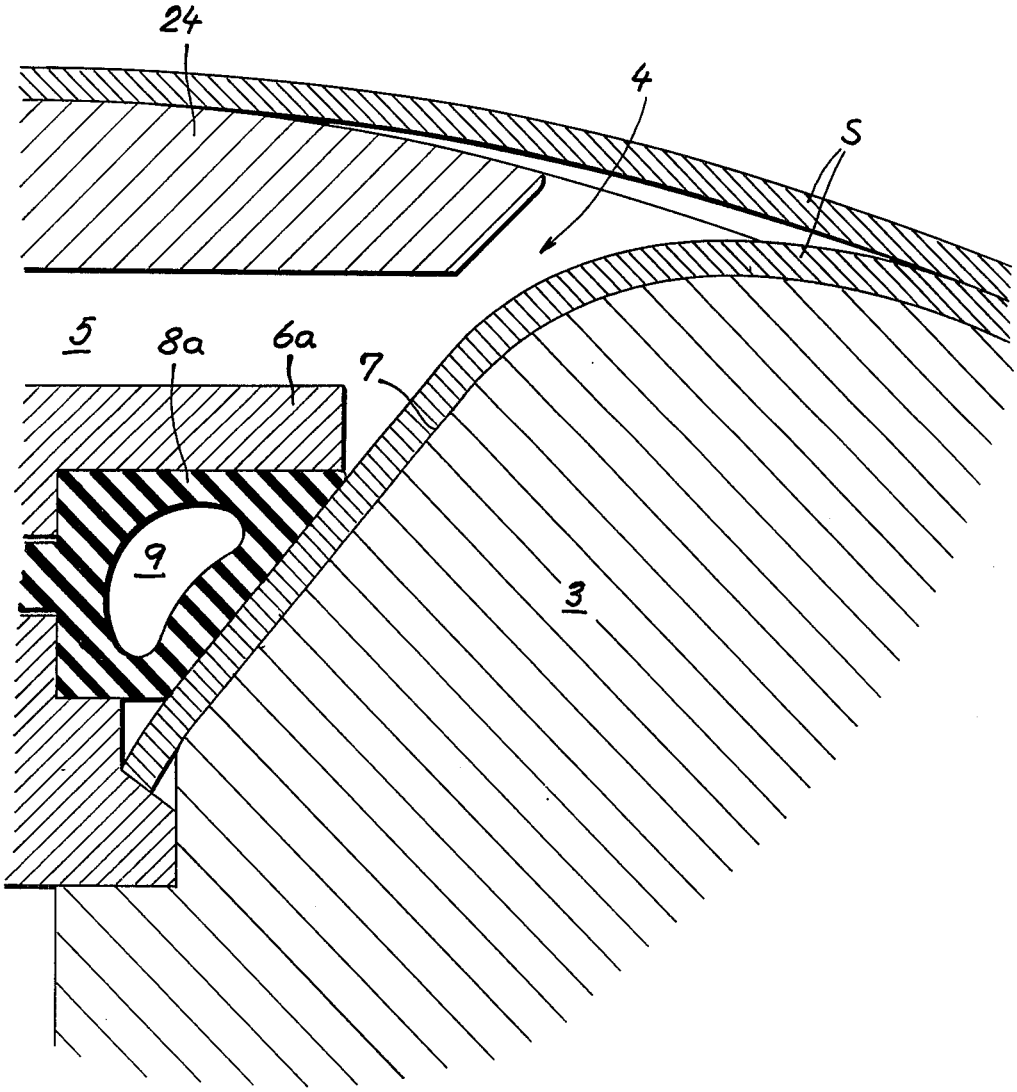
FIG. 3 is a detail view, drawn to an enlarged scale and corresponding to the same section as FIG. 2, of another embodiment of the invention.

In FIG. 3 it can be seen that the pressure member 8*a* is anchored in the longitudinal recess of the clamping bar 6*a*. The anchoring or fastening can be achieved by various means as described previously but preferably uses a foot received in a groove of member 6 which is undercut.

Figure 4:
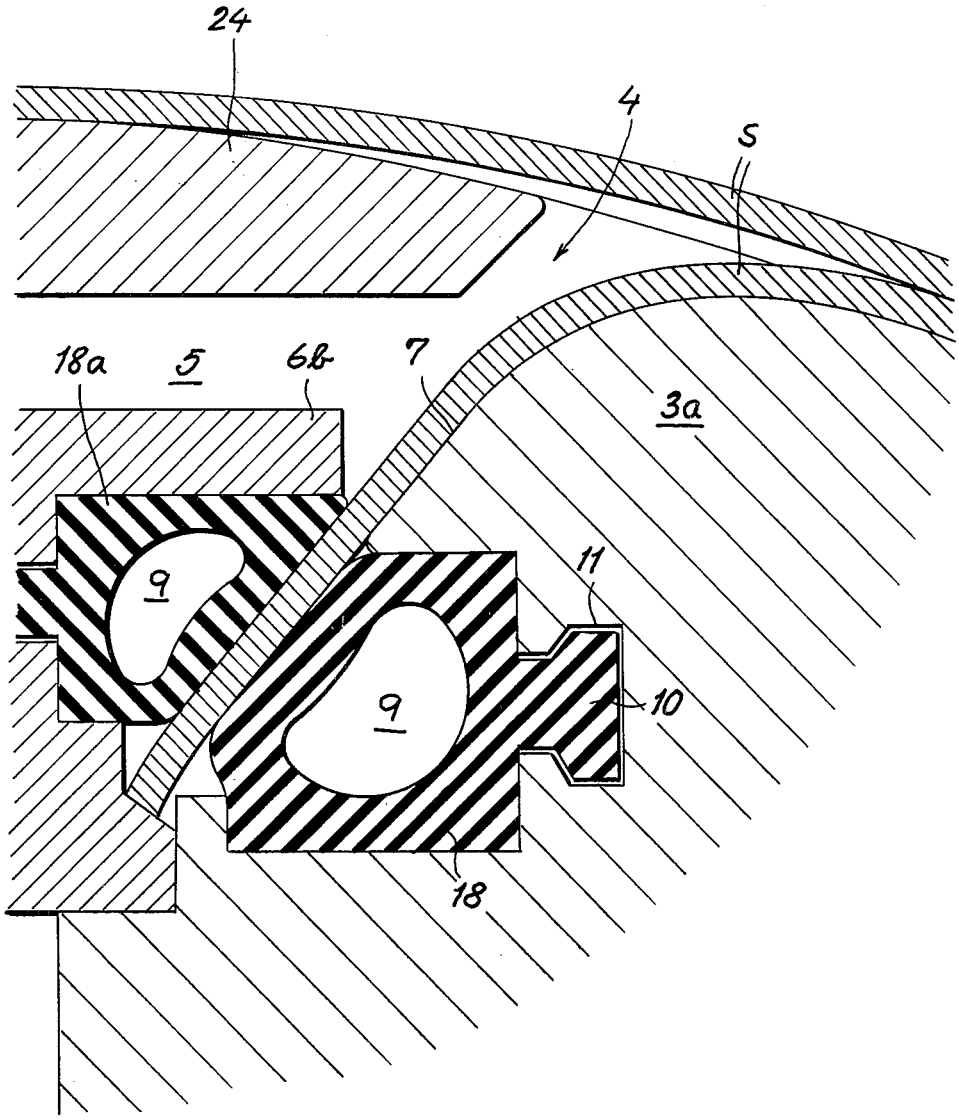
FIG. 4 is a detail section similar to FIG. 3 illustratanother embodiment of the invention.

FIG. 4 shows that the pressure member 18*a* can be provided in the clamping bar 6*b* while a pressure member 18 is provided in segment 3*a*. In this modification, the longitudinal recess 11 in which the foot 10 is received, is of dovetail cross section and receives the complementarily shaped foot 10 of the pressure member 18, A T-section recess and foot can also be used.

Figure 5:
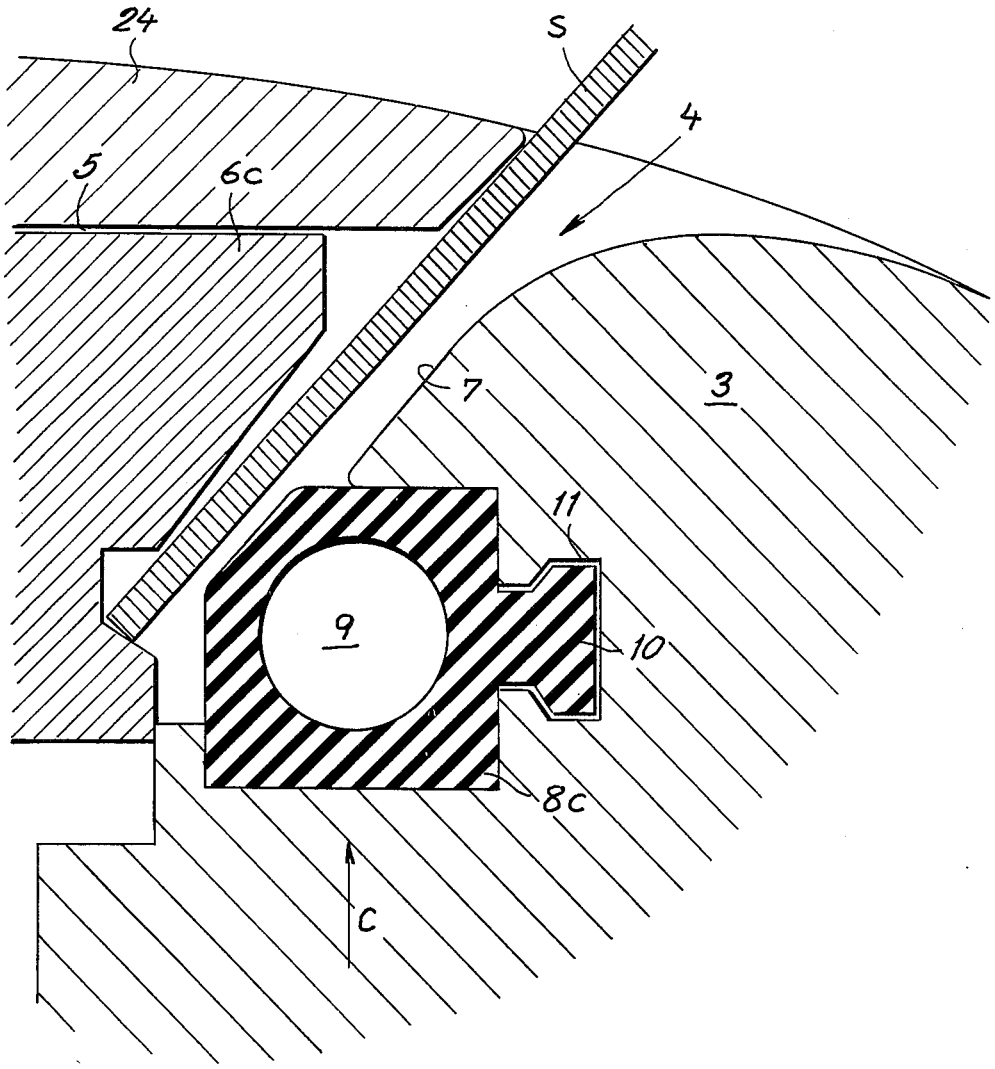
FIG. 5 is a sectional view corresponding to FIG. 4 showing the clamping members in an open position.

FIG. 5 shows the open position of the groove in which the material S is inserted. When segment 3 is moved radially in the direction of arrow C, the contact surface will engage the material S when the latter is clamped and the coiling operation begins. The contact surface S preferably merges into the cylindrical configuration of the periphery of the drum 1 and this eccentric curvature, preferable that of a spiral or involute, can have a varying radius of curvature as represented by the arrow R in FIG. 2. This rounding of the surface 7 permits smooth merger of the strip from its clamped portion into its cylindrical portion and prevents transmitting sharp bends to subsequent turns of the coil.

Figure 7:
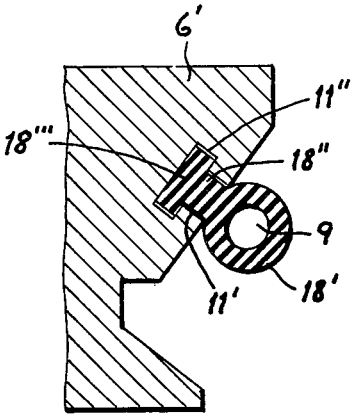
FIG. 7 is a cross-sectional view taken along the line VII—VII of FIG. 6.
Figure 6:
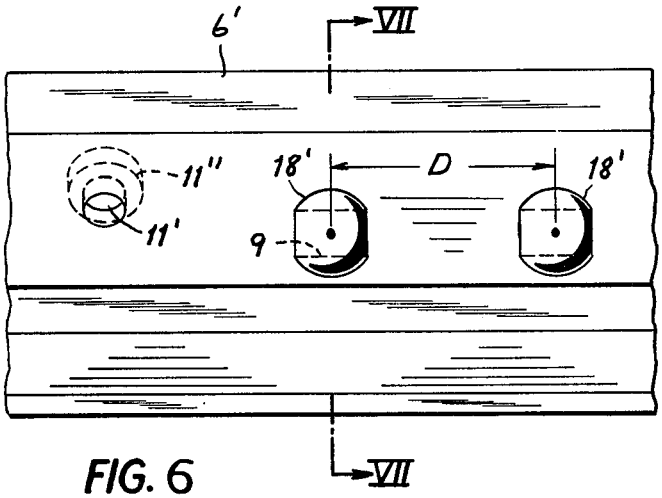
FIG. 6 is a side elevational view of a fixed segment according to the invention in which the resilient elements or members are ball-like bodies.

In FIGS. 6 and 7, I have shown a configuration of the clamping bar 6' in which openings 11' are provided, the openings 11' being undercut at 11'' to receive T-section cylindrical feet of ball-shaped compression members 18' which are hollow as illustrated. The ball-shaped members 18' may be provided in spaced-apart relationship as shown in FIG. 6, i.e., with a center to center distance D and can have necks 18'' received with the bores 11' and large diameter feet 18''' received within the undercuts 11'', as illustrated in FIG. 7.

Figure 9:
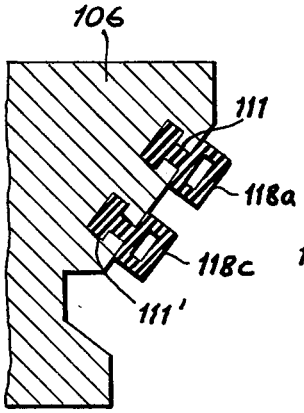
FIG. 9 is a cross-sectional view taken along the line IX—IX of FIG. 8.
Figure 8:
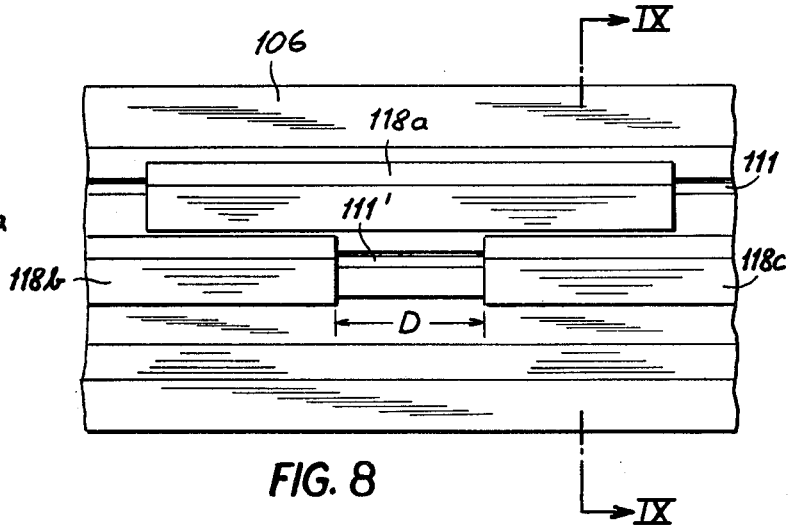
FIG. 8 is a view similar to FIG. 6 illustrating another embodiment of the invention.

In the embodiments of FIGS. 8 and 9, the pressure members 118*a*, 118*b* and 118*c* are provided in spaced-apart relationship, i.e., with a spacing D', and in separate rows in the clamping bar 106. Here again the members 118*a–c* are formed with inverted-T-section feet which are received in correspondingly shaped grooves 111 and 111' (FIG. 9).

Of course, the members illustrated in FIG. 6 through 9 can also be provided in the segment 3 previously described.

I claim:

1. A strip coiler comprising a drum shaft;

at least one drum segment shiftable on said shaft and at least one clamping bar mounted on said shaft and juxtaposed with said segment, said segment and said bar defining a clamping gap between them and having juxtaposed clamping surfaces, the displacement of said segment relative to said bar engaging an end of a strip to be coiled between said surfaces; and at least one elastically compressible member mounted on one of said surfaces for engagement with said strip, said member being formed with a hollow permitting compression of the material of said member without extrusion thereof between said one of said surfaces and said strip upon compression of said member.

2. The strip coiler defined in claim 1 wherein the hollow in said member is a transverse bore.

3. The strip coiler defined in claim 1 wherein said one of said surfaces is formed with a recess accommodating said member and permitting the compression thereof.

4. The strip coiler defined in claim 1 wherein said member has a ball-like clamping surface.

5. The strip coiler defined in claim 1 wherein said member is composed of rubber or synthetic elastomer having a higher coefficient of sliding friction than the material of said one of said surfaces.

6. The strip coiler defined in claim 1 wherein said member has a profile merging with the profile of said one of said surfaces.

7. The strip coiler defined in claim 1 wherein said member is formed with a foot and said one of said surfaces is provided with an undercut recess receiving said foot for anchoring said member to said one of said surfaces.

8. The strip coiler defined in claim 1 wherein said surface of said segment is formed as a logarithmic spiral merging with the cylindrical periphery of said segment.

9. The strip coiler defined in claim 1 wherein at least one such member is provided on each of said surfaces.

10. The strip coiler defined in claim 9 wherein said members are disposed opposite one another.

11. A strip coiler comprising a drum shaft;

at least one drum segment shiftable on said shaft and at least one clamping bar mounted on said shaft and juxtaposed with said segment, said segment and said bar defining a clamping gap between them and having juxtaposed clamping surfaces, the displacement of said segment relative to said bar engaging an end of a strip to be coiled between said surfaces; and a plurality of elastically compressible members mounted on one of said surfaces for engagement with said strip, said members being spaced apart along said one of said surfaces in at least one row.

12. The strip coiler defined in claim 11 wherein the hollow in each of said members is a transverse bore.

13. The strip coiler defined in claim 11 wherein said one of said surfaces is formed with recesses accommodating said members and permitting the compression thereof.

14. The strip coiler defined in claim 11 wherein each of said members has a ball-like clamping surface.

15. The strip coiler defined in claim 11 wherein each said member is composed of rubber or synthetic elastomer having a higher coefficient of sliding friction than the material of said one of said surfaces.

16. The strip coiler defined in claim 11 wherein each of said members has a profile merging with the profile of said one of said surfaces.

17. The strip coiler defined in claim 11 wherein each of said members is formed with a foot and said one of said surfaces is provided with an undercut recess receiving said foot for anchoring said member to said one of said surfaces.

18. The strip coiler defined in claim 11 wherein said surface of said segment is formed as a logarithmic spiral merging with the cylindrical periphery of said segment.

19. The strip coiler defined in claim 11 wherein at least one such member is provided on the other of said surfaces.

20. The strip coiler defined in claim 19 wherein the members on both surfaces are disposed opposite one another.

* * * * *